United States Patent [19]

Hagemeister

[11] Patent Number: 4,577,841

[45] Date of Patent: Mar. 25, 1986

[54] BENT WIRE SPRING UNIT

[75] Inventor: Robert C. Hagemeister, Boston, Mass.

[73] Assignee: Webster Spring Co. Inc., Oxford, Mass.

[21] Appl. No.: 631,991

[22] Filed: Jul. 18, 1984

[51] Int. Cl.[4] ..... A47C 23/02

[52] U.S. Cl. ..... 267/103; 5/247; 5/255

[58] Field of Search ..... 267/91, 100, 101, 103, 267/104, 105, 106, 107, 108, 109, 95; 5/247, 255, 476, 246, 474, 267, 268, 269, 270

[56] References Cited

U.S. PATENT DOCUMENTS

| | | | |
|---|---|---|---|
| 243,355 | 6/1881 | Blumenstein et al. | 5/270 X |
| 813,244 | 2/1906 | Smith | 5/267 |
| 2,681,457 | 6/1954 | Rymland | 5/464 X |
| 3,200,417 | 8/1965 | Costello | 5/474 X |
| 3,428,304 | 2/1969 | Rowe | 267/97 |
| 3,517,398 | 6/1970 | Patton | 5/464 |
| 3,561,021 | 2/1971 | Slominski | 5/247 |
| 3,574,241 | 4/1971 | Slominski | 5/247 R |
| 3,833,948 | 9/1974 | Surletta et al. | 5/247 |
| 4,004,304 | 1/1977 | Kane | 5/267 |
| 4,068,329 | 1/1978 | Gross et al. | 5/255 |
| 4,398,705 | 8/1983 | Mizelle | 5/247 X |
| 4,470,584 | 9/1984 | Mizelle | 5/476 X |

FOREIGN PATENT DOCUMENTS

| | | | |
|---|---|---|---|
| 202185 | 6/1956 | Australia | 5/474 |
| 827221 | 2/1960 | United Kingdom | 267/95 |

*Primary Examiner*—George E. A. Halvosa
*Attorney, Agent, or Firm*—Robert T. Gammons

[57] ABSTRACT

A spring assembly comprising a base frame and a grid frame held in spaced, parallel relation by transversely and longitudinally-spaced spring units, some of which are bent wire spring units and others of which are coil spring units, each bent wire spring unit being yieldable in bending and torsion to pressure applied to their upper ends, and symmetrical with respect to its vertical axes.

7 Claims, 12 Drawing Figures

BENT WIRE SPRING UNIT

BACKGROUND OF THE INVENTION

Box springs for beds are generally made of a rigid, rectangular base frame and a wire grid frame supported in spaced, parallel relation by a plurality of interposed spring units spaced transversely and longitudinally of the frames. Two types of springs are used, for example, coil springs and bent wire springs. Spring assemblies where all of the springs are coil springs are prone to be too soft and, hence, insufficiently supported at the sides and ends, while spring assemblies comprised of the bent wire type are prone to be too stiff and to damage the mattress. It is the purpose of this invention to provide a spring assembly wherein both coil springs and bent wire springs are used with the bent wire springs distributed along the sides and ends where pressure is concentrated, as contrasted to the central area where the pressure is distributed, but not so stiff as to damage the mattress. A further object of the invention is to provide a bent wire spring unit of improved construction structured to be snapped onto the grid frame as are the coil springs shown in U.S. Pat. No. 4,004,304. Another object is to provide bent wire springs structured to be used in spring assemblies exclusively of coil spring units.

SUMMARY OF THE INVENTION

The spring units herein illustrated are of the bent wire type, especially constructed to be disposed between the base frame and the grid frame along the sides and ends of a conventional spring assembly wherein coil springs are employed intermediate the sides and ends. However, it is to be understood that these bent wire spring units can be substituted entirely for the coil springs of conventional coil spring assemblies. Each bent wire spring unit comprises vertically-spaced, parallel, top and bottom attaching elements and transversely-spaced supports connecting the top and bottom of attaching elements such as to permit the top and bottom attaching elements to move relative to each other in response to pressure applied perpendicularly to the top attaching element, said supports each comprising vertical lengths of wire of lesser length than the distance between the top and bottom attaching elements and upper and lower lengths of wire inclined with respect to the vertical lengths of wire connecting the upper and lower ends of the vertical elements to the upper and lower attaching elements. The supports connecting the top and bottom attaching elements comprise oppositely-facing, substantially C-shaped lengths of wire comprising vertical lengths and divergent lengths at the upper and lower ends thereof, the distal ends of the divergent lengths being connected to the top and bottom attaching elements. The C-shaped lengths of wire constituting the supports are substantially perpendicular to the top and bottom attaching elements and situated in spaced, parallel planes relative to each other. Each top and bottom attaching element comprises spaced, parallel lengths of wire joined at their opposite ends by a diagonal length of wire. The spaced, parallel lengths of wire of the top attaching element contain deviations and the spaced, parallel lengths of wire of the bottom attaching element are straight. The spring units are symmetrical with respect to their vertical axes in planes at right angles to each other.

The spring assembly as disclosed in one form comprises a rectangular base frame embodying longitudinally-spaced, parallel, transversely-extending support bars, a substantially rectangular grid frame comprising a border wire and transversely and longitudinally-crossing grid wires attached at their ends to the border wire and to each other at their crossings with the bent wire units positioned between the base frame and the grid frame along the sides and ends and coil springs distributed throughout the area between the sides and ends. Both the bent wire springs and the coil springs are supported at their lower ends on the support bars and are engaged at their upper ends with the longitudinal wires of the grid frame. The coil springs are attached at their upper ends, as are the coil springs shown in U.S. Pat. No. 4,004,304. The bent wire spring units are symmetrical with respect to their vertical axis in planes at right angles to each other transversely and longitudinally of the base frame and are attached at their lower ends to a single support bar and at their upper ends to a pair of adjacent longitudinal grid wires. Each bent wire spring unit has at its lower end spaced, parallel lengths of wire connected by a diagonal length of wire which collectively define an attaching lower end for contact with a support bar and staples are employed to attach the lower end to the support bar. Each bent wire spring unit has at its upper end spaced, parallel lengths of wire connected by a diagonal length of wire. The parallel lengths of wire contain deviations like those at the upper ends of the coil springs shown in the aforsaid U.S. Pat. No. 4,004,304 for snap-on interengagement with the longitudinal grid wires to lock the upper ends to the grid frame. The lower and upper ends of the bent wire spring units are yieldably connected to each other by spaced, parallel, oppositely-facing, C-shaped supports oriented so that the C-shaped supports are parallel the transverse support bars.

In another form, the spring assembly is comprised entirely of bent wire spring units throughout the length and breadth.

The invention will now be described with reference to the accompanying drawings, wherein.

Figure 1:
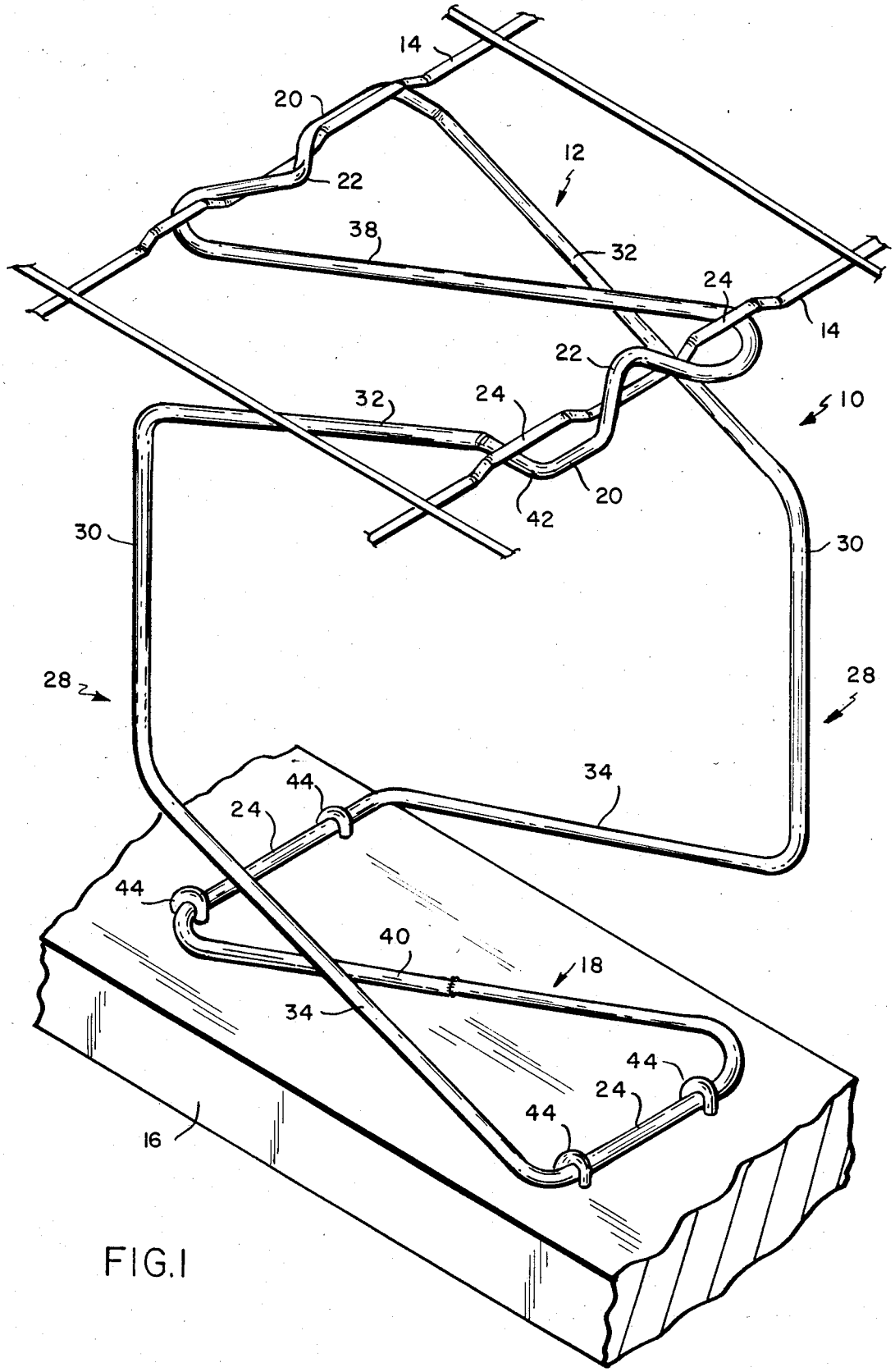
FIG. 1 is a perspective of the spring unit of this invention shown interposed between and attached to a base frame and a grid frame.
Figure 2:
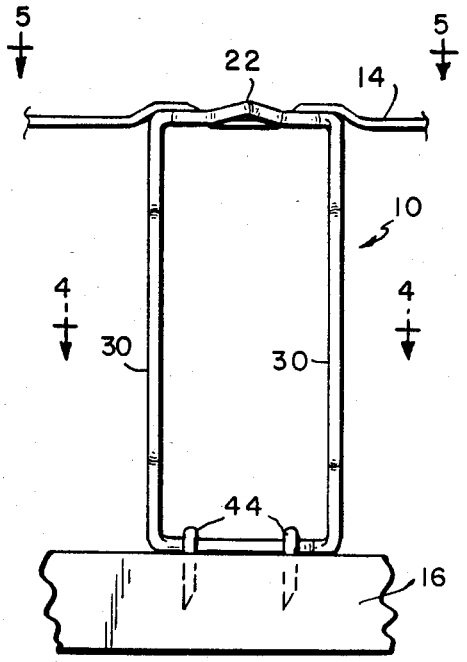
FIG. 2 is an elevation of a spring unit as seen from one side with its lower end attached to a support bar of a base frame and its upper end attached to a grid frame.
Figure 3:
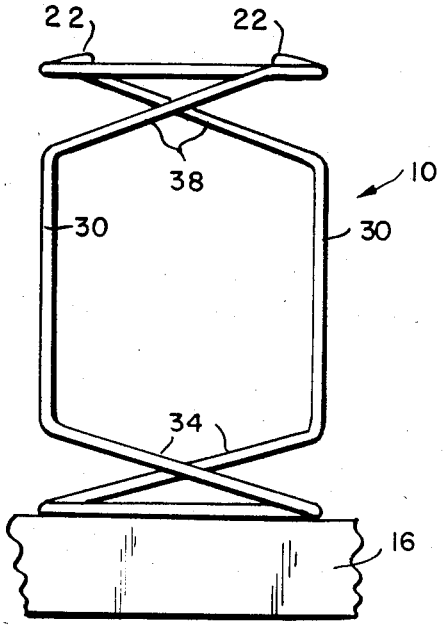
FIG. 3 is an elevation taken at right angles to FIG. 2.
Figure 4:
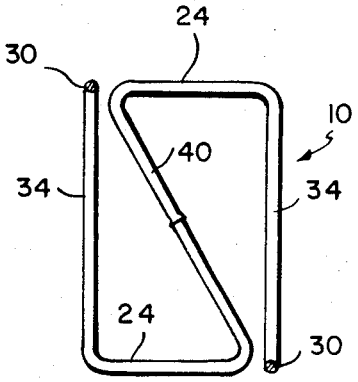
FIG. 4 is a plan view taken on the line 4—4 of FIG. 2.
Figure 5:
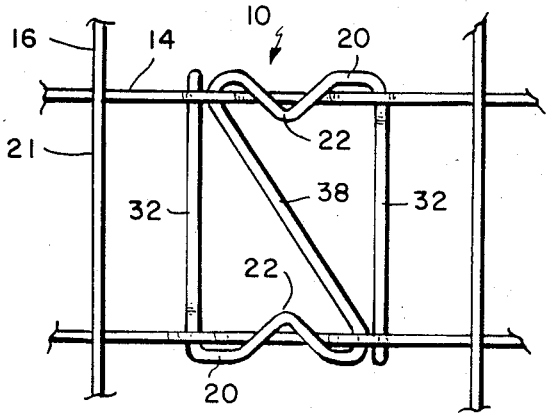
FIG. 5 is a plan view taken on the line 5—5 of FIG. 2.

Referring to FIGS. 1 and 5, the bent wire spring units 10 are shown disposed between the longitudinal wires 14-14 of a grid frame and a transverse support bar 16 of a base frame. The bent wire spring units 10 are disposed in combination with coil spring units or exclusively of coil spring units in transversely and longitudinally-spaced relation, as will appear hereinafter, with their upper ends attached to the longitudinal wires of the grid frame and the lower ends attached to the transverse bars of the base frame.

Each bent wire spring unit 10 comprises an upper attaching element 12, a lower attaching element 18 and interposed yieldable supports 28-28 which permit yield of the upper and lower attaching elements relative to each other. More specifically, the upper attaching element 12 comprises spaced, parallel lengths of wire 20-20 connected at their opposite ends by a diagonal length of wire 38 and the lower attaching element 18 comprises spaced, parallel lengths of wire 24-24 connected at their opposite ends by a diagonal length of wire 40. The supports 28-28 comprise spaced, parallel, generally C-shaped frames disposed in oppositely-facing relation to each other comprising substantially vertical lengths of wire 30-30 and at the opposite ends diverging lengths of wire 32,34 at the upper and lower ends which are connected, respectively, to one end of the upper and lower lengths of the lengths of wire 20 and 24. The opposite ends of the lengths of wire 20-20 and 24-24 are connected to each other, respectively, by diagonal lengths of wire 38 and 40. At the junctions of the upper ends of the wires 32-32 with the ends of the lengths of wire 20-20, there are horizontal lengths of wire 42-42 structured to prevent the grid wires 14-14 from sliding down the inclined lengths of wire 32-32. The lengths of wire 32-32 and 34-34 are at right angles to the lengths of wire 20-20 and 24-24 and the lengths of wire 38-38 and 34-34 are inclined at angles of 15° to 25° to the horizontal.

As shown in FIG. 1, the upper attaching elements 12-12 are attached to adjacent longitudinal grid wires 14-14 by deviations 22-22 formed in the spaced lengths of wire 20-20 which extend toward each other and which are interengaged with the deviations 24-24 formed in the wires 14-14. The deviations 22-22 for securing the upper attaching elements to the wires 14-14 are like those shown in U.S. Pat. No. 4,004,304. The lower attaching elements 18-18 are attached to the support bar 16 by means of staples 44 driven into the bar over the lengths of wire 24-24. If the base frame is metal, the support bar 16 may be provided with tangs 46 for securing the lower attaching elements as shown in FIG. 5A.

The supports 28-28 provide for yield of the top attaching element relative to the bottom attaching element by bending of the lengths of wire 32 and 34 relative to the lengths of wire 30-30 and by torsion of the lengths of wire 22,24 relative to the lengths of wire 32,34.

Figure 5B:
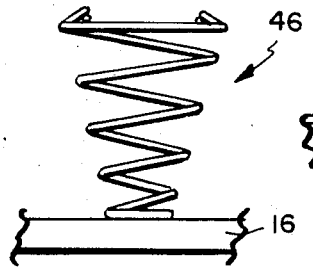
FIG. 5B is an elevation of a conventional coil spring attached at its lower end to a support bar and at its upper end to a grid frame.
Figure 5A:
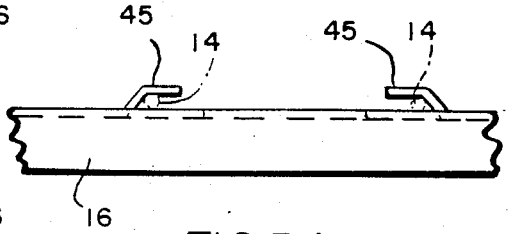
FIG. 5A is a fragmentary elevation of a metal base frame wherein the support bars have tabs stuck out of the base for clinching engagement with the lower ends of the spring units.
Figure 5C:
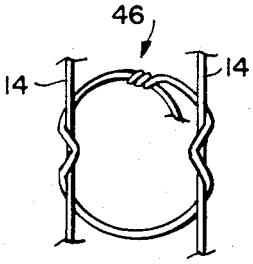
FIG. 5C is a plan view of the upper end of the coil spring attached to grid wires.
Figure 6B:
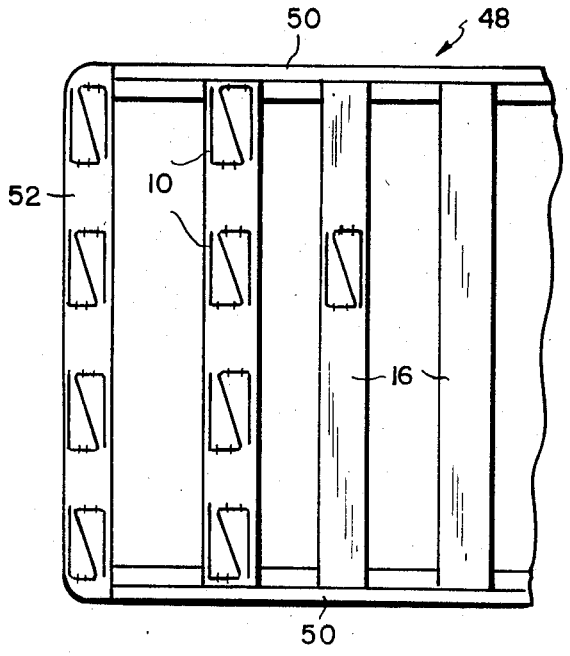
FIG. 6B is a fragmentary plan view of the base frame showing all of the spring units as bent wire spring units attached at their lower ends to the support bars.
Figure 6A:
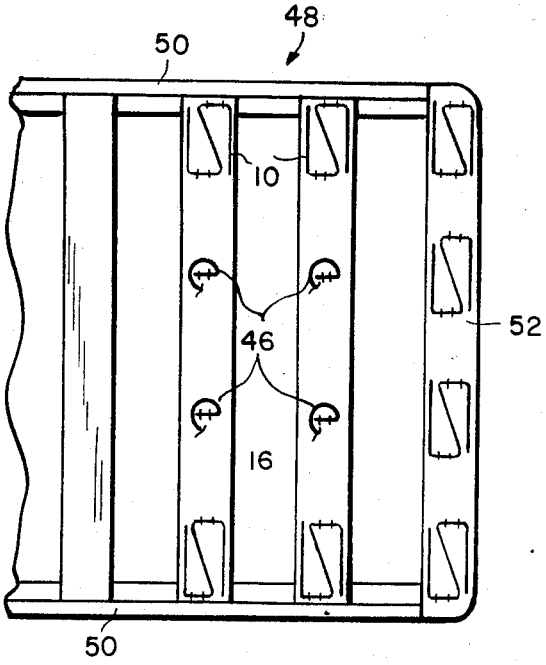
FIG. 6A is a fragmentary plan view of the base frame showing spring units comprising bent wire spring units attached to the sides and ends and coil springs intermediate the sides and ends attached at their lower ends to the support bars.
Figure 7B:
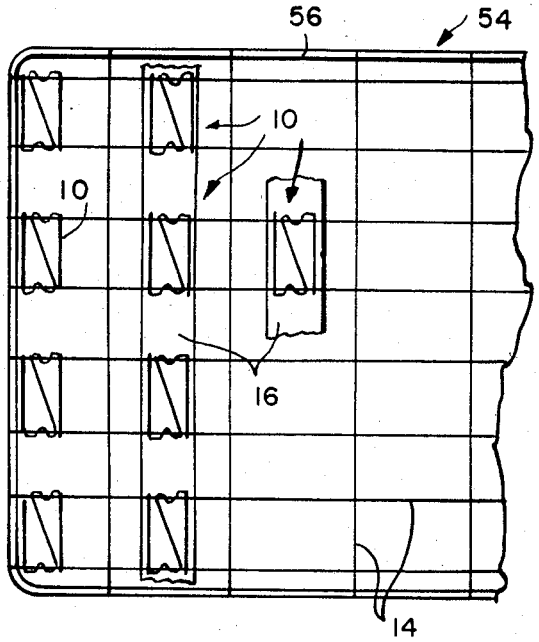
FIG. 7B is a fragmentary plan view of the grid frame showing all of the spring units as bent wire spring units attached at their upper ends to the grid wires of the grid frame.
Figure 7A:
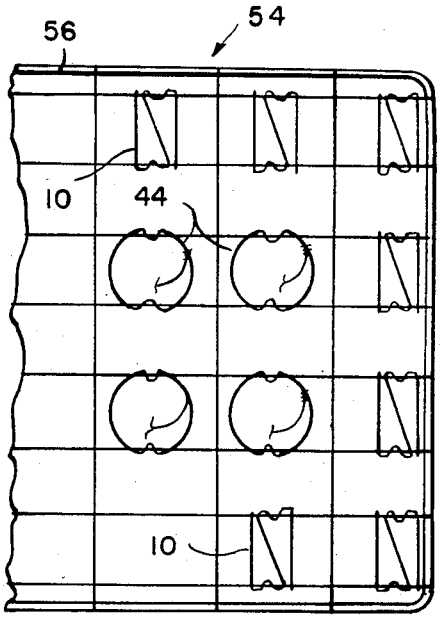
FIG. 7A is a fragmentary plan view of the grid frame showing spring units comprising bent wire spring units at the sides and ends and coil springs intermediate the sides and end attached to the wires of the grid frame.

In accordance with one form of the invention, as illustrated in FIGS. 6A and 7A, bent wire spring units 10 of the kind shown in FIGS. 1 to 5 are used in conjunction with conventional coil wire spring units 46 such as shown in FIGS. 5B and 5C and in U.S. Pat. No. 4,004,304.

Referring to FIGS. 6A and 7A, there is shown, respectively, a base frame 48 comprised of spaced, parallel sides 50-50, spaced, parallel ends 52-52 and transversely-disposed, longitudinally-spaced, parallel support bars 16 and a grid frame 54 comprising a border wire 56 of rectangular configuration provided with longitudinally and transversely-extending grid wires 14 connected at their ends to the border wire and to each other at their crossings. As disclosed in FIGS. 6A and 7A, the bent wire spring units 10 are arranged along the sides and ends and the coil springs 46 are arranged intermediate the sides and ends. As shown in FIGS. 6B and 7B, the bent wire spring units 10 are used exclusively throughout the length and breadth of the base frame and grid frame.

The bent wire spring units 10 are symmetrical in planes at right angles to each other and provide resistance in bending and torsion to displacement and, hence, controlled yield which is stiff enough to support the edges and ends of the spring assembly in which they are used where pressure is generally the greatest without being so stiff as to damage the mattress supported thereby.

It should be understood that the present disclosure is for the purpose of illustration only and includes all modifications or improvements which fall within the scope of the appended claims.

What is claimed is:

1. A bent wire spring unit comprising first spaced, parallel attaching elements adapted to be attached at longitudinally and transversely-spaced intervals to pairs of spaced, parallel grid wires of the grid frame and the support members of a base frame of a spring assembly comprising a base frame and a grid frame wherein the grid frame comprises a border wire and crossing grid wires attached at their ends to the border wire and the base frame comprises rectangularly-arranged, spaced, parallel end and side members and longitudinally-spaced, parallel support members fixed at their opposite ends to the side members, and spaced, parallel, C-shaped lengths of wire disposed between the attaching elements and connected thereto, said C-shaped lengths of wire being disposed in planes perpendicular to the planes of the attaching elements and at a spacing corresponding to the length of the attaching elements and each comprising a first length of wire connected at one end to one end of the top attaching element and inclined downwardly from said one end, said first lengths of wire being inclined downwardly in opposite directions, second lengths of wire connected at one end to one end of the bottom attaching element and inclined upwardly, said second lengths of wire being inclined in opposite directions, third lengths of wire perpendicular to the top and bottom lengths of wire connected at their upper and lower ends with the inclined lengths of wire and diagonal lengths of wire situated in the planes of the top and bottom attaching elements connected at their opposite ends to the other ends of the top and bottom attaching elements.

2. A bent wire spring unit according to claim 1 wherein there are horizontal lengths of wire at the upper ends of the upper inclined lengths of wire joining the upper ends thereof to the attaching elements.

3. A bent wire spring unit according to claim 1 wherein the diagonal length of wire lies in the plane defined by the parallel lengths of wire.

4. A bent wire spring unit according to claim 1 wherein the spaced, parallel lengths of wire of the top attaching element contain deviations for locking engagement with the grid wires and the spaced, parallel lengths of wire at the bottom attaching element are straight.

5. A spring assembly according to claim 4 wherein the longitudinal wires of the grid frame contain deviations for interengagement with the deviations in the parallel lengths of wire at the upper ends of the bent wire spring units.

6. A bent wire spring unit according to claim 1 wherein the inclination of the inclined lengths of wire is approximately 15° to 25° to the horizontal.

7. A bent wire spring unit according to claim 1 wherein the inclined lengths of wire are integrally connected to the ends of the spaced, parallel lengths of wire of the attaching elements at angles of approximately 90° such that downward displacement of the attaching element relative to the bottom attaching element is resisted by bending at their junctions with the vertical lengths of wire and by resistance in torsion of the spaced, parallel lengths of wire.

* * * * *